US006908602B1

(12) United States Patent
Gosselink et al.

(10) Patent No.: US 6,908,602 B1
(45) Date of Patent: Jun. 21, 2005

(54) HYDROCARBON CONVERSION PROCESS

(75) Inventors: Johan Willem Gosselink, Amsterdam (NL); Michiel Jan Groeneveld, Amsterdam (NL); Andreas Karl Nowak, Amsterdam (NL); Antonius Adrianus Maria Roovers, Amsterdam (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/030,894

(22) PCT Filed: May 9, 2000

(86) PCT No.: PCT/EP00/04397

§ 371 (c)(1),
(2), (4) Date: Nov. 12, 2001

(87) PCT Pub. No.: WO00/69990

PCT Pub. Date: Nov. 23, 2000

(30) Foreign Application Priority Data

May 13, 1999 (EP) ..... 99303733

(51) Int. Cl.[7] ..... C01B 3/26

(52) U.S. Cl. ..... 423/652; 208/107; 208/108; 208/109; 208/113; 208/118; 252/373; 585/752

(58) Field of Search ..... 208/107, 108, 208/109, 113, 118; 585/752; 252/373; 423/651, 652, 655

(56) References Cited

U.S. PATENT DOCUMENTS 3,189,538 A 6/1965 Pohlenz et al.
3,224,958 A 12/1965 Haritatos et al.
3,463,611 A 8/1969 Haritatos et al.
4,225,418 A * 9/1980 Hilfman ..... 208/111.15
5,152,976 A * 10/1992 Fong et al. ..... 423/652
5,853,566 A * 12/1998 Kraushaar-Czarnetzki et al. ..... 208/109
6,406,912 B1 6/2002 Holla ..... 435/814

FOREIGN PATENT DOCUMENTS

AU 200049227 B2 12/2000 ..... C10G/47/00
DE 18 16 828 A 7/1969
EP 0 214 717 A 3/1987 ..... C10G/49/08
EP 0 635 555 A2 1/1995 ..... C10G/45/02
EP 0 635 555 A3 6/1995 ..... C10G/45/02

OTHER PUBLICATIONS

Indonesian Patent Office Official Action and English translation, Indonesian Patent Application No. W–00200102475, dated Jun. 18, 2004.

* cited by examiner

*Primary Examiner*—Stanley S. Silverman
*Assistant Examiner*—Maribel Medina

(57) ABSTRACT

Method for producing hydrogen and a hydroprocessed product from a hydrocarbonaceous feedstock by subjecting it to a catalytic hydrocracking treatment using hydrogen which has been at least partly produced from hydrocracked feedstock and subjecting at least pan of the hydrocracked feedstock, after having subjected it to a separation treatment in the event that hydroprocessed product is to be recovered, to a treatment to produce hydrogen in a single operation which hydrogen is at least partly recovered as product.

22 Claims, 1 Drawing Sheet

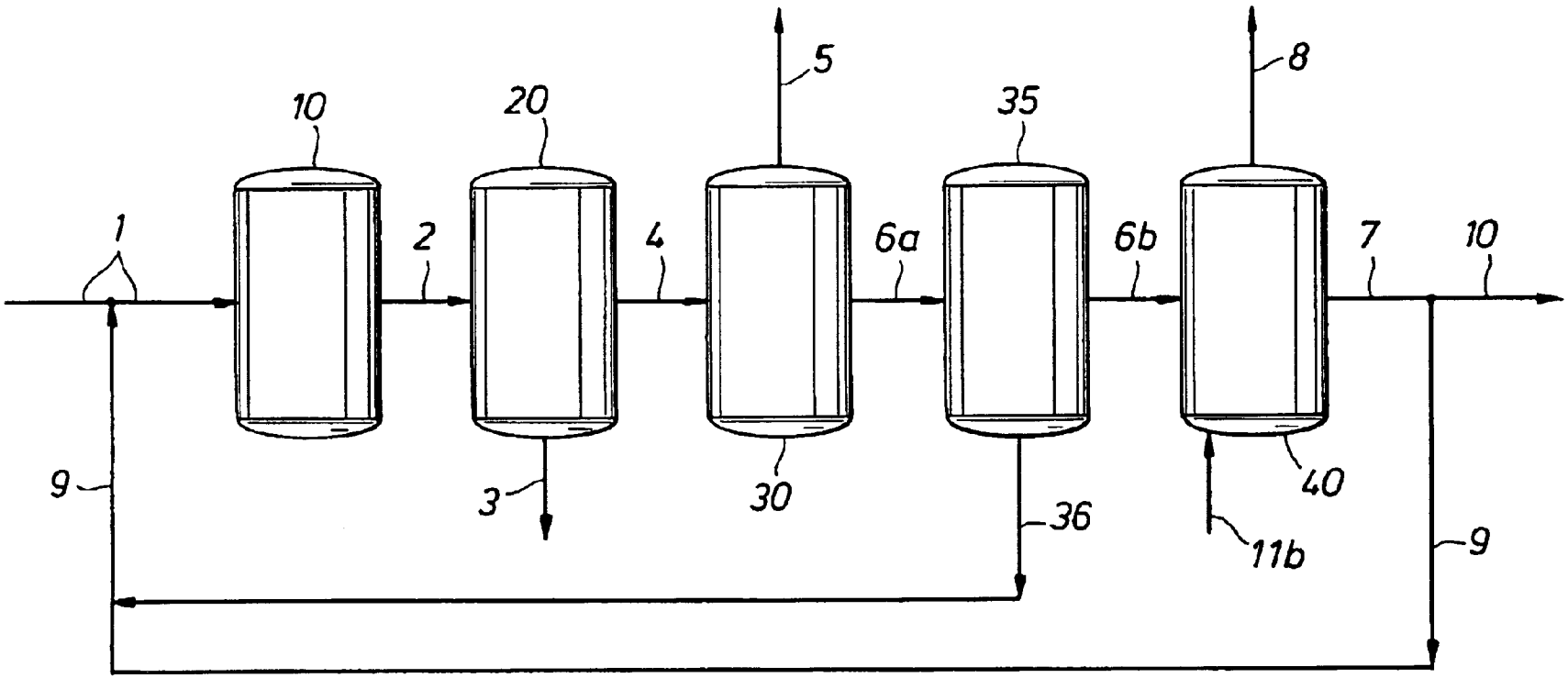
10
9
7
40
8
11b
6b
35
36
6a
5
30
4
20
3
2
10
1
9

HYDROCARBON CONVERSION PROCESS

The present invention relates to a process for converting hydrocarbonaceous feedstocks in a flexible manner.

For many years, refiners have been, and to some extent still are, focusing on maximising the size of the capacity as far as possible or on optimising the infrastructure of existing refineries in order to minimise costs or, even better, to find the most pragmatic solution for both maximising throughput and optimising infrastructure. In this approach, and even when designing grass-roots refineries, the emphasis is on large refineries as the huge costs involved can only be justified by the processing of large amounts of feedstocks, especially since the present day markets are international and product made in one location can be sold in other locations. Such refineries, sometimes referred to as export-refineries, have proven their existence over the years.

In the context of existing refineries it is understandable because of fixed logistics that adaptations are designed in such a way that they fit with the current infrastructure which means that whilst certain adaptations may possibly be optimal for a certain part of the refinery, they most likely are not for another part, or even all other parts of the refinery.

In order to curb the costs of refineries one can think of downsizing the scale of the operations but it is easy to understand that in downsizing the scale of a refinery, the advantages gained because of the increase in size, and its complementary optimisation of the intrinsic infrastructure are lost, if not completely than at least to a large extent.

Moreover, fixed operations like those performed in huge refineries do not have much flexibility and one can not cope easily with changes in the market place, in particular when such changes would be radical, rather frequent and not easy to predict.

An example of a refinery scheme which has been designed to become more simple in that it could be built on a compact plot plan and at possibly low capital investment costs has been described in European published patent application EP-A-635555. In essence, the refinery scheme as disclosed in EP-A-635555 is directed at operating a single hydrotreating unit followed by a distillation into a number of fractions.

The difference between the refinery scheme as proposed in EP-A-635555 and the prior art referred to in said document is said to be that in conventional refining crude oil is separated into several fractions which are then (hydro) treated individually. The results described when using a feedstock containing C5–360° C. material (the total of the four fractions normally obtained when the feedstock is firstly subjected to distillation) give the impression that a refinery can be simplified to a great extent without reducing the hydrotreating effect obtained in the prior art. It is clear, however, that when the fraction containing C4 and lower hydrocarbons (the C4-fraction), also forming part of the crude oil taken in but not forming part of the hydrotreating process of the C5–360° C. material, is used additionally in the single hydrotreating unit, the results are less encouraging. It is further stated in EP-A-635555 that part of one of the products obtained after distillation can be sent to a catalytic reformer in order to produce hydrogen which can be used in the single hydrotreating step.

In U.S. Pat. No. 3,463,611 a process has been described which is aimed at recovering sulphur from sulphur-containing feed streams by a rather complex line-up designed at concentrating hydrogen sulphide in a sufficiently high concentration in a recycle stream of which a purge gas stream is fed to a partial oxidation zone after which hydrogen sulphide and carbon dioxide removed from that zone are led to a Claus process for the manufacture of sulphur. The process as described in U.S. Pat. No. 3,463,611 is in essence a hydrogen consuming process which may need additional make up hydrogen which can be fed into the hydrogen line to the hydroconversion unit.

In U.S. Pat. No. 3,224,958 a process has been described in which a hydrocarbon feed is separated into a light and a heavy fraction which are separately subjected to a hydroconversion step followed by combined working up of the converted feedstocks comprising a catalytic hydrogenation unit, a gas generator and a shift reactor in order to produce recycle hydrogen of passable quality. Some hydrogen of low quality is removed as a purge stream prior to the gas generator and shift conversion stages. In essence, the process as described in U.S. Pat. No. 3,224,958 is directed at the production of hydrocarbons rather than hydrogen.

In U.S. Pat. No. 3,189,538 a process has been described in which hydrogen is produced not only from a converted feedstock but also from a cracking/regeneration system tailored to produce hydrogen from an auxiliary charge whilst integrating parts of the cracker/regenerator overhead with the hydrogen supply to the hydrogen consuming process. In essence, the process as described in U.S. Pat. No. 3,189,538 is inflexible in that it requires two not integrated hydrogen production units, one of which being a fluidized cracking unit which is very expensive and not normally used as a hydrogen production facility. Moreover, in order to operate such process no less than three different hydrocarbon charges have to be used to supply the main conversion processes.

It has now been found that flexibility can be improved by further process integration to the extent that part of the product obtained in a hydrocracking operation should be used as feedstock for producing hydrogen which is used in the hydrocracking operation to produce the desired refinery products. The hydrocracking operation should be carried out in such a way that, depending on the product slate envisaged, a fraction is produced which can be used optimally in the production of hydrogen. This means that the process according to the present invention achieves the combined goals of reconstituting the feedstock by the treatment in the hydrocracker whilst at the same time producing or increasing the amount of the fraction which is elected to serve in toto or in part as feedstock for the hydrogen production facility to be used in the hydrocracking operation.

The present invention therefore relates to a process for producing hydrogen and a hydroprocessed product from a hydrocarbonaceous feedstock by subjecting it to a catalytic hydrocracking treatment using hydrogen which has been at least partly produced from hydrocracked feedstock and subjecting at least part of the hydrocracked feedstock, after having subjected it to a separation treatment in the event that hydroprocessed product is to be recovered, to a treatment to produce hydrogen in a single operation which hydrogen is at least partly recovered as product, characterised in that the amount of hydrogen produced by the process exceeds the amount of hydrogen needed in the process.

The process according to the present invention comprises therefore in essence a hydrocracking operation, optionally a separation operation and a hydrogen production operation provided with the appropriate feed inlet, product outlet(s) and hydrogen transfer line(s).

The process according to the present invention can be carried out in a number of ways, depending on the nature of the feedstock, the severity of the intended hydrocracking operation and the type and amount of the specific hydrocracked feedstock fraction to be used as feedstock for the hydrogen producing facility.

Hydrocarbonaceous feedstocks which can be suitably applied in the process according to the present invention are those ranging from having an initial boiling point of about ambient to those having a final boiling point of about 650° C., measured under standard conditions of temperature and pressure (20° C. and 1 atmosphere). It will be clear that feedstocks which can be applied in the method according to the present invention do not need to have a boiling range profile encompassing the total range disclosed hereinabove. Feedstocks having a boiling point range such that their 90% boiling point (i.e. the temperature at 'which '90% of the feedstock would have been distilled off in a distillation process) lies in the range between 400 and 600° C. can be advantageously applied. Preference is given to feedstocks having a 90% boiling point in the range between 450 and 600° C. Good results can be obtained with feedstocks having a 90% boiling point in the range from 475 to 550° C.

Examples of feedstocks which can be suitably applied are naphtha, kerosene and various types of gas oils such as atmospheric gas oil and vacuum gas oil. Also cycle oils can be suitably applied. Not only feedstocks from mineral origin but also from synthetic origin can be applied. Synthetic or semi-synthetic feedstocks are preferred from a low sulphur and/or nitrogen point of view as such feedstocks reduce the necessity of having sulphur and/or nitrogen removing processes forming part of product upgrading. Hydrocarbonaceous materials formed from syngas via the so-called Fischer-Tropsch process form a very useful feedstock for the process according to the present invention as such feedstocks would obviate the need for sulphur and/or nitrogen treatment and removal facilities.

It is possible that the hydrocarbonaceous feedstocks to be applied in the process according to the present invention contain also materials boiling below ambient temperature. Such materials may be present in the feedstock to be applied or can be added to such feedstock. Reference is made to the presence of lower hydrocarbons or hydrocarbon fractions such as liquefied petroleum gas.

It is advantageous to use a feedstock which contains between 5 and 40% by weight of material having a boiling point range which is higher than the boiling point range of the hydroprocessed product.

Feedstocks containing sulphur containing materials can also be processed. Normally, the amount of sulphur will not exceed 5% by weight, and preferably will not exceed 3% by weight. Preference is given to feedstocks containing even lower amounts of sulphur, or no sulphur at all.

It will be clear to those skilled in the art that extraneous hydrogen will have to be introduced in the context of the start-up of the process according to the present invention. Part or all of the hydrogen to be consumed during the hydrocracking step of the process according to the present invention will be generated in the hydrogen manufacturing unit forming part of the line-up.

The catalytic hydrocracking treatment in according with the present invention can be suitably carried out at temperatures in the range between 200 and 550 DC, preferably between 250 and 450° C. Pressures up to 400 bar can be suitably applied, preference is given to pressures in the range between 10 and 200 atmospheres.

In the process according to the present invention at least part of the hydrogen to be used in the hydrocracking treatment will be generated from hydrocracked feedstock. Therefore, catalyst are preferably used which are capable of converting not only that part of the feedstock which delivers the hydroprocessed product but also of converting other parts of the feedstock to such an extent that the remaining hydrocracked feedstock is a good source for hydrogen production. In other words, preference is given to catalysts which also produce large amounts of lower boiling materials (besides the hydrocracked product).

Examples of catalysts which can be used in the hydrocracking treatment in accordance with the process in accordance with the present invention are zeolitic catalysts having a tendency to overcrack hydrocarbon-aceous material from a conventional point of view (in which as far as possible only those fractions of the feedstock are cracked which deliver the desired hydrocrackate whilst preserving as much as possible of the initial feedstock, or at least to the extent that liquid material will remain and therefore minimising the production of gaseous material). In the process in accordance with the present invention, it is advantageous to apply hydrocracking catalysts which are capable of producing besides, the desired product(s) also a fair amount of lower boiling materials, which from a conventional hydrocracking point of view is not preferred at all. Examples of such catalysts can be based on zeolite beta, zeolite Y, ZSM-5, erionite and chabazite. It will be clear to those skilled in the art which specific zeolite material and which specific metal (s) having hydrocracking capabilities can be used, taking into account that preference is given to catalysts giving rather high yields on relatively lights products as such products reduce the severity of that part of the process which is directed at the production of hydrogen. As an example suitable catalysts comprise zeolite beta containing one or more of Group VI and/or one or more of Group VIII metals. Examples of Group VI metals comprise Mo and W. Examples of Group VIII metals comprise Ni, Co, Pt and Pd. Suitable catalysts contain between 2 and 40% by weight of Group VI metals and/or between 0.1. and 10% by weight of Group VIII metals. Suitably, the catalysts are supported catalysts. Examples of suitable supports are alumina, silica, silica-alumina, magnesia, zirconia and mixtures of two or more of such supports. Alumina is a preferred support material, optionally in combination with silica-alumina.

Also combinations of two or more catalysts can be suitably applied. Examples of catalyst combinations include so-called stacked-bed catalysts which comprise using different beds filled with (different) catalytic material. The choice of the specific combinations of catalyst beds will be dependent on the process mode envisaged as is known to those skilled in the art.

An important embodiment of the process according to the present invention is one wherein kerosene and/or gas oil is (are) the hydroprocessed product(s) to be recovered from the process whilst hydrogen is produced in an amount exceeding the amount required to satisfy the internal needs of the process.

The remaining hydrocracked feedstock, optionally in combination with part, or even all of the hydroprocessed product in cases when there is no direct outlet for that product, will then be subjected to a treatment to produce hydrogen in a single operation of which at least part is recovered as product (in addition to the amount used to satisfy the hydrogen requirement (consumption) of the process according to the present invention). The surplus hydrogen can be used as export hydrogen which as such is then available for various applications, such as chemical reagent or as a source for producing electricity.

The process according to the invention allows for the production of hydrogen of good quality, i.e. hydrogen having a purity of at least B0%, preferably at least 90% which enlarges the window of operation.

It will be clear that during start-up procedures, use will have to be made of an outside hydrogen source until the process is self-sufficient with respect to its hydrogen consumption. For instance, use can be made of hydrogen available in storage containers.

As some hydrogen may already be present in the feedstock to the hydrogen-producing machine, it can be useful to separate it and use it as part of the amount of hydrogen needed to satisfy the hydrogen requirement of the process. This can be conveniently done by subjecting the hydrocracked feedstock to a separation process involving a membrane which will allow passage of hydrogen whilst retaining heavier molecules. Those skilled in the art know which membrane to use and how to operate such membrane.

There are many processes known in the art which are capable of producing hydrogen from hydrocarbonaceous feedstocks. Those skilled in the art know such processes and how to operate them. Producing hydrogen in a single operation can be carried out in one vessel but optionally in two or more vessels such as in a unit which is composed of a catalytic partial oxidation step and one or more shift conversion steps. A convenient process is catalytic (partial) oxidation. Other suitable processes are steam-methane reforming and catalytic dehydrogenation of lower alkanes such as propane or butane.

A preferred hydrogen-producing system can be found in the combination of catalytic partial oxidation and the watergas-shift reaction which last reaction, in essence, converts carbon monoxide, produced together with hydrogen in the catalytic partial oxidation reaction, in the presence of water (steam under the process conditions) to hydrogen and carbon dioxide. The net result of the combined catalytic oxidation/watergas-shift reaction is that hydrocarbonaceous material is converted into hydrogen and carbon dioxide.

Normally, the combined catalytic partial oxidation/watergas-shift process can be operated at a efficiency of at least 50%, calculated on hydrogen produced, preferably with an efficiency of at least 65%, calculated on hydrogen produced (not taking into account hydrogen present in the hydrocracked feedstock).

Suitable catalysts for the catalytic partial oxidation process in accordance with the process according to the present invention comprise one or more metals of Group VIII of the Periodic Table of the Elements supported on a carrier. Examples of suitable metals comprise rhodium, iridium and ruthenium as well as combination of two or more of these metals. Especially carriers having a high tortuosity can be suitably applied. Suitable process conditions comprise using oxygen:carbon molar ratios in the range between 0.30 and 0.80, preferably between 0.45 and 0.75, and most preferably between 0.45 and 0.65; temperatures between 800° C. and 1200° C., in particular between 900° C. and 1100° C. whilst using a gas velocity in the range between 100,000 and 10,000,000 1/kg/hr, preferably in the range between 250,000 and 2,000,000 1/kg/hr.

An advantage of the process according to the present invention is that when hydrogen is produced as the main product, carbon dioxide is produced at the same time in appreciable amounts which may be useful for commercial operations such as for enhanced oil recovery or for heating purposes in the event that an appropriate infrastructure is available (such as urban communities and/or green-house agriculture).

Since feedstocks containing up to about 5% wt of sulphur can be used in the process according to the present invention, the treatment with hydrogen will cause production of hydrogen sulphide. It will be clear that in such instances a further process step will be necessary to remove hydrogen sulphide from the hydrocracked feedstock and to convert it into sulphur. When the pressure is released prior to separating off the hydroprocessed product, hydrogen sulphide will be removed preferentially and can be sent to a further processing unit such as a SCOT-unit, or, if the concentration of hydrogen is large enough it can be fed directly to a CLAUS-unit. Those skilled in the art know such processing facilities and how to operate them.

Various embodiments of the process according to the present invention can be schematically illustrated by means of FIGURE.

In Figure an embodiment is illustrated in which a sulphur-containing feedstock is processed in such a way as to deliver at least one hydroprocessed product to be recovered as marketable product together with hydrogen produced for use in the process according to the present invention as well as for export.

A feedstock is introduced via line 1 into hydrocracking unit 10 in which the feedstock is subjected to a catalytic treatment with hydrogen under hydrocracking conditions. Hydrogen is introduced into line 1 via line 9. From hydrocracking unit 10 the hydrocracked feedstock is sent via line 2 to separating unit 20 from which a hydroprocessed product will be obtained via line 3 and a hydrogen sulphide containing hydrocracked stream will be obtained which is sent via line 4 to a hydrogen sulphide removal unit 30. From unit 30 a hydrogen sulphide containing stream will be obtained which is sent via line 5 to a sulphur recovery unit (not, shown) to produce sulphur, and a hydrogen sulphide depleted hydrocracked stream which can be sent via line **6*a* to hydrogen separating unit 0.35 (or in the event that hydrogen is not separated at this part in the process directly via line 6 (6*a*+6*b*) to hydrogen manufacturing unit 40) from which hydrogen separated off is sent back via line 36 to line 1 as part of the hydrogen needed in hydrocracking unit 10 and the remaining hydrogen sulphide (and optionally hydrogen) depleted hydrocracked feedstock is sent via line 6***b* to hydrogen manufacturing unit 40. In the event that this unit contains a catalytic partial oxidation stage and a watergas-shift stage, water (or steam) will be sent to the watergas-shift stage via line 11*b*. Carbon dioxide will be obtained via line 8 and: hydrogen produced will be sent back to the hydrocracking unit 10 via lines 7 and 9 (optionally together with hydrogen via line 36) whereas excess hydrogen can be made available via line 10.

In Figure a further process embodiment can be illustrated in which a sulphur containing feedstock is processed in such a way that all hydrocracked feedstock (including the fraction which is recoverable as hydroprocessed product) is used to produce (excess) hydrogen, i.e. a process in which apart from sulphur and carbon dioxide only hydrogen is the final product. In this embodiment the hydroprocessed product normally to be recovered via line 3 is now sent together with hydrocracked feedstock via line 4 to hydrogen sulphide removal unit 30 whereafter the further steps are as depicted in Figure.

A further embodiment in accordance with the process according to the invention is that wherein use is made of a sulphur-free feedstock (i.e. of a feedstock of synthetic or semi-synthetic nature or of a feedstock which has already been subjected to a hydrodesulphurization treatment). In such embodiment, it is no longer necessary to separate off a hydrogen sulphide containing hydrocracked feedstock (or to send the total hydrocracked feedstock to the (optional) hydrogen separating unit) which means that the process as schematically represented in Figure is now operated whithout using hydrogen sulphide removal unit 30.

EXAMPLES

The process according to the present invention can be illustrated by the following prophetic examples.

Example 1

A hydrocarbonaceous feedstock having an IBP of 121° C. and a 90% boiling point of 533° C. and containing 0.02% by weight of sulphur can be passed (in an amount of 10 tons/day together with 1.5 tons/day of hydrogen, representative for the hydrogen/feedstock ratio) over a zeolite beta type alumina supported catalyst in hydrocracking unit 10 under conditions to convert in single pass 90% wt of the feedstock to lower boiling material. As product, 45% wt, calculated on hydrocarbonaceous feedstock intake, of a hydroprocessed product (comprising kerosene and gas oil) can be obtained whilst the remaining hydrocracked feedstock can be sent to the hydrogen sulphide removal unit. After separating off hydrogen present in the hydrocracked feedstock (and returning it to the feedstock to be used as part of the hydrogen needed in the hydrocracking unit) after leaving the hydrogen sulphide removal unit, 55% wt, calculated on hydrocarbonaceous feedstock, can be sent to hydrogen manufacturing unit 40 (containing a catalytic partial oxidation unit in conjunction with a watergas-shift reactor) to which steam in an amount of 7 tons/day can be added. Under the prevailing conditions, 1.1 tons/day of hydrogen can be produced (together with the formation of 17 tons/day of carbon dioxide). Of the amount of hydrogen produced, 200 kg/day can be used to balance the hydrogen consumption in hydrocracking unit 10 whilst 900 kg/day can be available for export.

Example 2

A hydrocarbonaceous feedstock as defined in Example 1 can be subjected to a treatment designed at producing excess hydrogen as the main product (both in order to satisfy the internal needs of the process and for export availability). With a hydrogen consumption of 400 kg/day and under a conversion of 90% per pass to be obtained by using a zeolite beta type catalyst as described in Example 1 a hydrocracked feedstock is produced, which after hydrogen sulphide removal and separating off recycle hydrogen can be sent in its entirety to the hydrogen manufacturing unit which also needs to be supplied with 13.3 ton/day of steam. The unit can produce 2.05 ton/day of hydrogen of which an amount to satisfy the internal needs of the process can be sent to the hydrocracking unit (taking into account the amount of hydrogen already liberated in the separating off operation prior to hydrogen manufacture). Under the conditions as given above 32 ton/day of carbon dioxide can be co-produced whilst 1.65 ton/day of hydrogen can become available for export.

What is claimed is:

1. Process for producing hydrogen and a hydroprocessed product from a hydrocarbonaceous feedstock, comprising subjecting the hydrocarbonaceous feedstock to a catalytic hydrocracking treatment using hydrogen which has been at least partly produced from hydrocracked feedstock and subjecting at least part of the hydrocracked feedstock, after having subjected it to a separation treatment in the event that hydroprocessed product is to be recovered, to a treatment to produce hydrogen in a single operation which hydrogen is at least partly recovered as product, the amount, of hydrogen produced by the process exceeds the amount of hydrogen needed in the process, wherein part or all of the non-recovered material from the catalytic hydrocracking treatment is subjected to a catalytic oxidation process which produces hydrogen and carbon (di)oxide.

2. The process of claim 1, in which use is made of feedstocks ranging from those having an initial boiling point of about ambient to those having a final boiling point of about 650° C.

3. The process of claim 2, in which use is made of feedstocks having a boiling point range such that their 90% boiling point lies in the range between about 400° C. and about 600° C.

4. The process of claim 1, in which use is made of feedstocks having a sulphur content of not more than 5% wt.

5. The process of claim 1, in which a hydrocarbonaceous feedstock is used containing between about 5% wt and about 40% wt of material having a boiling point range which is the same or higher than the boiling point range of the hydroprocessed product to be recovered.

6. The process of claim 1, in which kerosene and/or gas oil are recovered as hydro-processed products from the hydrocracked feedstock.

7. The process of claim 1, in which the catalytic oxidation process comprises a catalytic partial oxidation step.

8. The process of claim 1, in which hydrogen sulphide generated by the hydrocracking treatment is converted into elemental sulphur by conventional means.

9. The process of claim 1, in which use is made of a hydrocracking catalyst system capable of converting at least 50% wt of the material, having a boiling point range which is higher than the boiling point range of the hydroprocessed product.

10. The process of claim 9, in which use is made of a hydrocracking catalyst containing zeolite beta as active component.

11. The process of claim 10, in which the zeolite beta-based catalyst is capable of converting at least 90% wt of the fraction to be treated to obtain the hydroprocessed product.

12. The process of claim 9, in which the hydrocracking treatment is carried out at a temperature between about 200 and about 550° C.

13. The process of claim 9, in which the hydrocracking treatment is carried out at a pressure up to about 400 atmospheres.

14. The process of claim 9, in which the hydrocracking treatment is carried out at a temperature between about 250° C. and about 450° C.

15. The process of claim 9, in which the hydrocracking treatment is carried out at a pressure between about 10 and about 200 atmospheres.

16. The process of claim 1, in which the hydrogen generated by the catalytic oxidation step has been produced at least partly from hydrocarbons containing at most 4 carbon atoms present in the hydrocarbonaceous feedstock or as produced during the hydrocracking treatment.

17. The process of claim 16, in which the feedstock to the catalytic oxidation step consists of hydrocarbons having about 4 or less carbon atoms.

18. The process of claim 1, in which hydrogen is separated off from the hydrocracked feedstock and from the hydroprocessed product if the latter is not to be recovered prior to the treatment to produce hydrogen.

19. The process of claim 1, in which use is made of feedstocks having a sulphur content of below 3% wt.

20. The process of claim 1, in which the catalytic oxidation process comprises a watergas-shift step.

21. The process of claim 20, in which hydrogen is produced from no feedstocks other than the hydrocarbonaceous feedstock and water used in the watergas-shift step.

22. The process of claim 1, in which use is made of a hydrocracking catalyst system capable of converting at least 65% wt of the material, having a boiling point range which is higher than the boiling point range of the hydroprocessed product.

* * * * *